United States Patent [19]

Borona et al.

[11] 4,270,031

[45] May 26, 1981

[54] CIRCUIT BREAKER INTERLOCKING MECHANISM

[75] Inventors: Russell T. Borona, Seymour; Kenneth R. Coley, Fairfield, both of Conn.

[73] Assignee: Westinghouse Electric Corp., Pittsburgh, Pa.

[21] Appl. No.: 24,768

[22] Filed: Mar. 28, 1979

[51] Int. Cl.[3] ..... H01H 9/26

[52] U.S. Cl. ..... 200/50 C; 200/DIG. 6; 200/42 T

[58] Field of Search ..... 200/50 C, 50 A, DIG. 6, 200/42 T

[56] References Cited

U.S. PATENT DOCUMENTS

| | | | |
|---|---|---|---|
| 3,158,701 | 11/1964 | Nadeau | 200/50 C |
| 3,492,448 | 1/1970 | Phillips, Jr. | 200/50 C |
| 3,705,280 | 12/1972 | Harms | 200/50 C |

*Primary Examiner*—J. V. Truhe
*Assistant Examiner*—Morris Ginsburg
*Attorney, Agent, or Firm*—L. P. Johns

[57] ABSTRACT

A circuit breaker interlocking mechanism characterized by a pair of circuit breakers connected to different power supply sources in comprising a locking member pivotally mounted between the circuit breakers for preventing one circuit breaker from being actuated when the other is in a preselected operating position.

5 Claims, 4 Drawing Figures

CIRCUIT BREAKER INTERLOCKING MECHANISM

BACKGROUND OF THE INVENTION

1. Field of the Invention

This invention relates to a pair of circuit breakers having interlocking means for preventing simultaneous operation thereof.

2. Description of the Prior Art

Alternate sources of electric power supply is necessary or desirable in some circumstances. For example, the availability of an emergency power supply is recognized for many businesses, industries, and hospitals. Another example is the need for dual power supplies in recreational vehicles which are often provided with on-board generator supply and appropriate circuit switching means for connection with utility supply. Recreational vehicles may have on-board generators for power which is usually 50 amperes. At a campsite or park, however, the use of utility supply at the campsite is usually 30 amperes.

Present technology for switching from the generator to the utility supply without running the utility supply into the generator and burning it up has been a problem. Associated with the foregoing has been a tendency in the recreational vehicle industry to add more circuits without increasing the physical size of the distribution center.

Prior U.S. patents relating to this invention are: U.S. Pat. Nos. 1,465,384; 3,158,701; 3,196,227; 3,213,326; 3,319,020; 3,492,448; 3,647,997; 3,705,280; and 3,769,553.

SUMMARY OF THE INVENTION

It has been found in accordance with this invention that the foregoing problems may be overcome by providing the power transfer device of this invention for switching from one power source to another which comprises a first circuit breaker connected to one power supply source, a second circuit breaker connected to another power supply source, a third circuit breaker proximate to the foregoing circuit breakers, each circuit breaker having a manual handle for each pole, interlocking means for preventing one power supply source from being turned on when the other power supply source is on, the means comprising an interlock member movable between the paths of movement of the manual handles of the first and second circuit breakers, and tie means for connecting the handles of similar poles of the first and second circuit breakers together and comprising a portion extending across the path of movement of the handles of the third circuit breaker to prevent movement of the handles of the third circuit breaker when one of the other circuit breakers is in one of the open and closed positions.

The advantage of the device of this invention is that it enables the use of standard products off the shelf to enable the inexperienced user to select the ampere rating for either generator or utility supply without factory assistance and with complete safety.

DESCRIPTION OF THE PREFERRED EMBODIMENT

Figure 1:
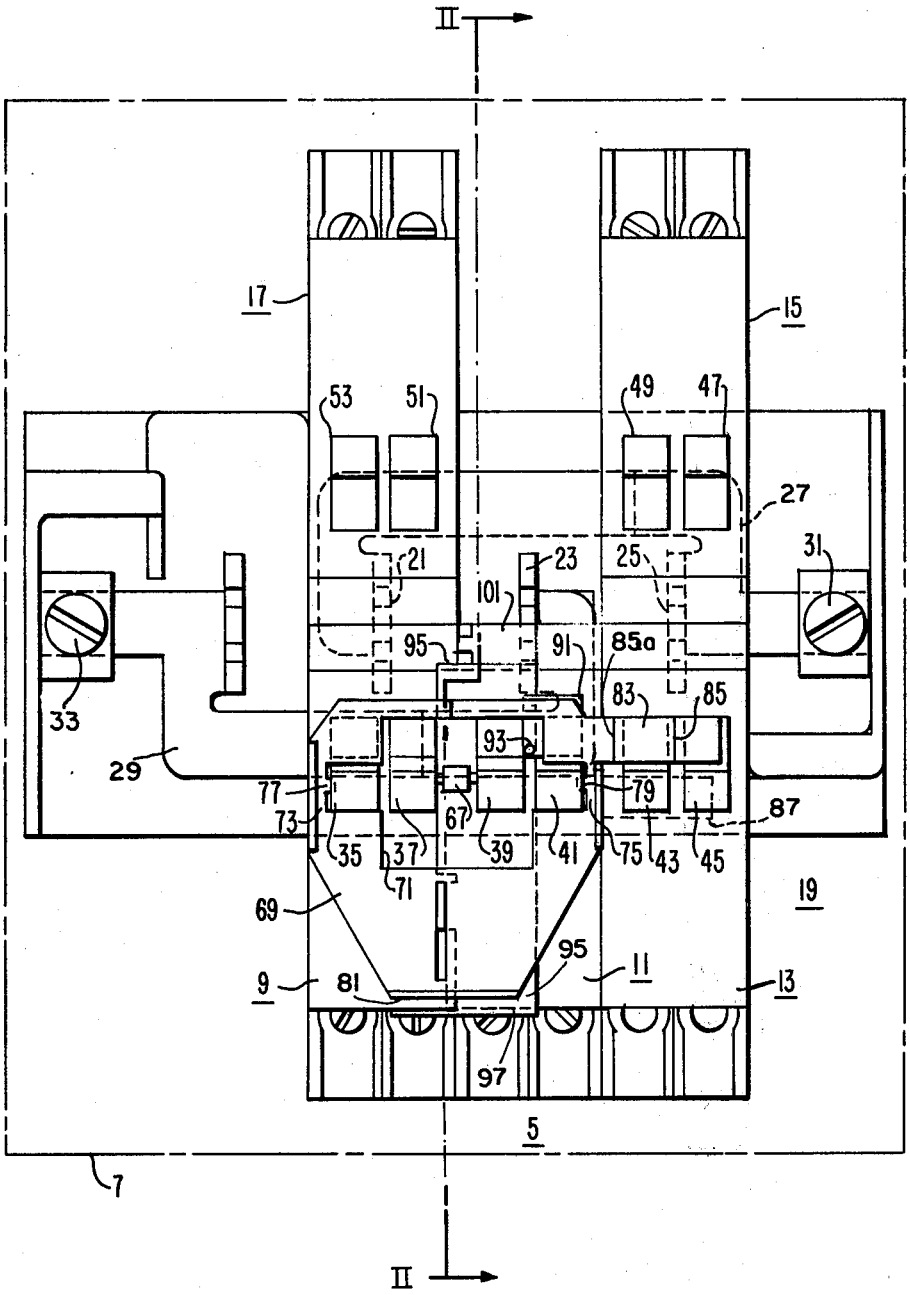
FIG. 1 is a plan view of a load center within an enclosure.

A load center is generally indicated at 5 in FIG. 1 and is contained within a box or enclosure 7. The load center 5 comprises a plurality of circuit breakers, such as circuit breakers 9, 11, 13, 15, and 17, which are mounted on a bottom wall 19 of the enclosure and which are connected to stabs 21, 23, and 25 as shown in FIG. 1. The stabs 21 and 25 are upright portions of a line conductor 29 and the stab 23 is an upright portion of a neutral conductor 27 which is connected by a screw 31 to neutral connections of branch circuits in a manner similar to that shown in U.S. Pat. No. 4,016,386. Similarly, the line conductor 29 comprises a screw 33 for connecting additional circuits.

The circuit breaker 9–17 are so-called duplex circuit breakers, such as disclosed in U.S. Pat. No. 3,110,786. Circuit breaker 9 comprises a pair of manual handles 35, 37, circuit breaker 11 comprises manual handles 39, 41, circuit breaker 13 comprises handles 43, 45, circuit breaker 15 comprises handles 47, 49, and the circuit breaker 17 comprises handles 51, 53. Each handle 35–53 is movable between ON and OFF, or closed and open positions of contacts within circuit breakers.

Figure 3:
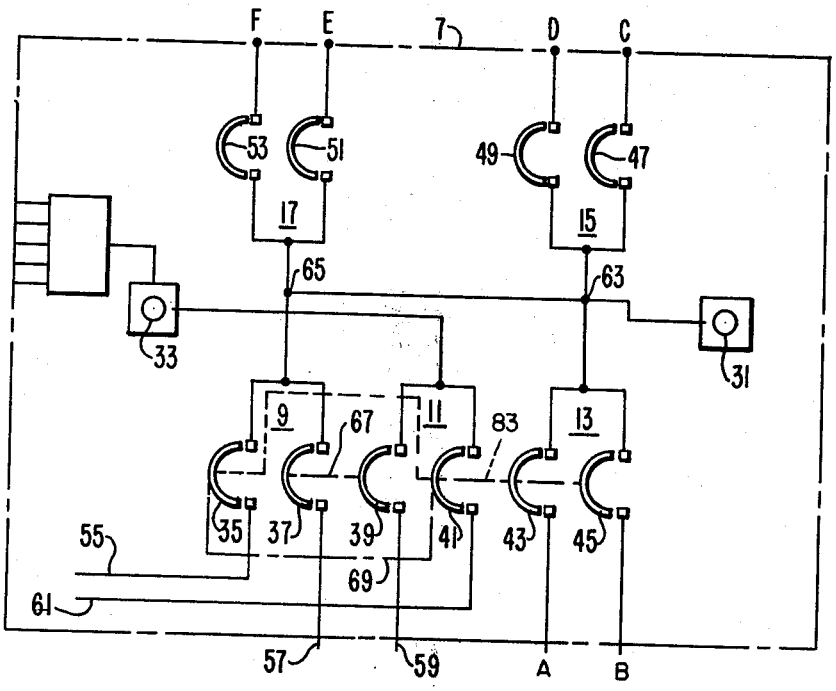
FIG. 3 is a wiring diagram for a typical recreational vehicle panel and transfer locking mechanism.

As shown more particularly in FIG. 3, the contact by the manual handle 35 is connected to a hot or line pole 55 of a first power supply and the contact for the handle 37 is connected to a hot or line pole of a second power supply 57. In a similar manner, the contact of the handle 39 is connected to a neutral pole 59 of the second power supply and the contact of the handle 41 is connected to a neutral pole 61 of the first power supply. The circuit breakers 13, 15, 17 are connected to 120 volt branch circuits A, B, C, D, E, and F, respectively. In addition, the separate contacts of each circuit breaker 13, 15, 17 are connected at 63, 65 downstream or on the load side, of circuit breakers 9 and 11.

Figure 2:
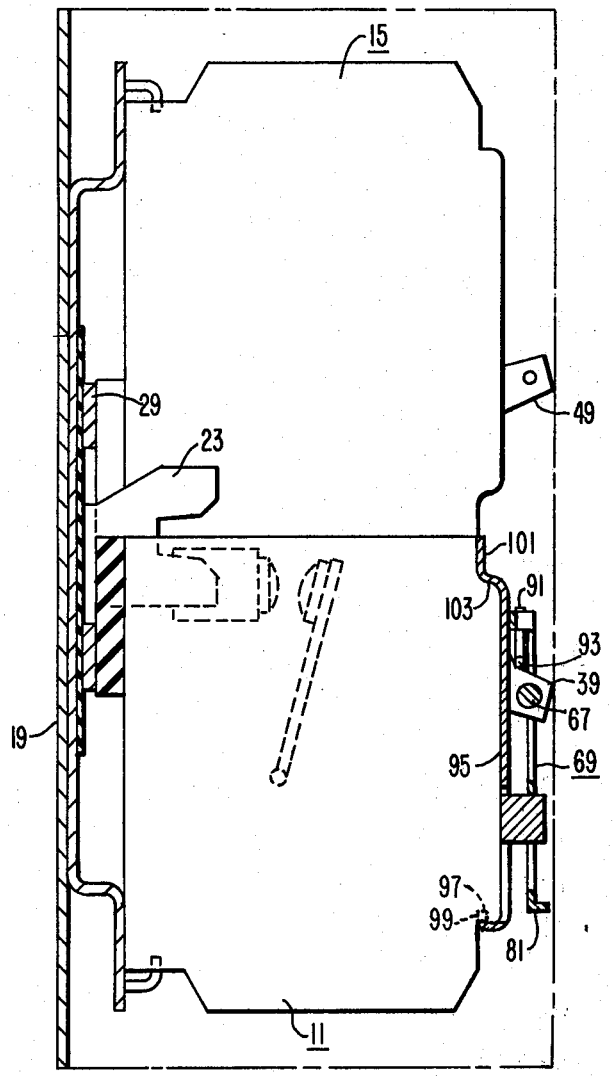
FIG. 2 is a vertical sectional view taken on the line II—II of FIG. 1.

In accordance with this invention, the handles 37, 39 are ganged or secured together by an interconnecting pin or tie 67 which extends therebetween and has opposite end portions secured in corresponding apertures in the handles. The handles 35, 41 are also ganged or secured together by a tie member 69 (FIGS. 1 and 2). The tie member 69 is a platelike member, preferably composed of sheet metal, and is disposed over the top surfaces of the circuit breakers 9, 11. The tie member 69 includes an opening 71 through which the handles 35–41 extend. The tie member 69 includes portions 73, 75 extending along opposite sides of the handles 35, 41. A tie or pinlike member 77 extends from the portion 73 into a hole in one side of the handle 35. Similarly, a tie or pinlike member 79 extends from the portion 75 into a hole in one side of the handle 41. Accordingly, when the tie member 69 is moved manually, such as by grasping an upturned flange 81 (FIG. 2), the handles 35, 41 are moved, but the handles 37, 39 extending through the opening 71 are unaffected.

The tie member 69 is also provided with an arm 83 extending outwardly to the right (FIG. 1) and into the path of movement of the handles 43, 45. When the tie member 69 is in the position (FIG. 1) wherein the handles 35, 41 are in the OFF position, the arm 83 prevents movement of the handles 43, 45 to the ON position. The arm 83 may be provided with a score line 85, between the positions of the handles 43, 45 to facilitate breaking and removal of an end portion of the arm 83 to enable movement of the handle 45, when the tie member 69 is in the position shown. Additionally, a score line 85*a* is supplied between the positions of the handles 41 and 43 on arm 83 which when broken at the score line 85*a* allows free movement of both handles 43 and 45.

Figure 1A:
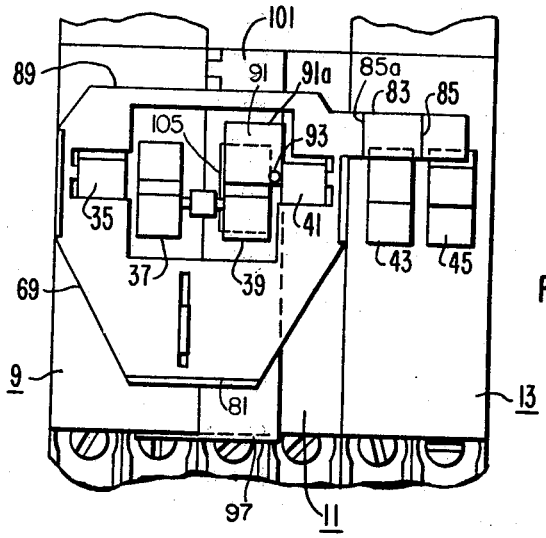
FIG. 1A is a fragmentary plan view of the structure of FIG. 1, and showing an alternate position of the switch.

In another embodiment of the invention the position of the arm 83 may be located on the opposite side of the handles 43, 45, such as in the broken line position 87 (FIG. 1), to prevent movement of the handles from the ON to the OFF position when the tie member 69 is in its alternate position such as shown at position 89 (FIG. 1A).

Moreover, this invention comprises an interlock or locking plate 91 for limiting movement of one of the handles 39, 41 when the other of said handles is in the ON position. As shown in FIG. 1 the locking plate 91 is pivotally mounted on a pin 93, the lower end of which is secured on a base plate 95 and which base plate is secured to the upper surface of the circuit breaker 11 at one end by an inturned end portion 97 which is seated in an end portion receiving notch 99 (FIG. 2). The opposite end portion 101 of the base plate 95 is disposed over a molded surface 103 of the top of the circuit breaker 11 for further securing the plate in place.

In addition, the base plate 95 comprises an opening 105 (FIG. 1A) through which the handle 39 extends so that the plate 95 extends around the handle. Accordingly, when the handles 35, 41 are moved by the tie member 69 to the ON position and when the tie member 69 is in the position 89, the handle 41 moves the locking plate 91 out of the way and into the position 91*a*. In the latter position, the handle 41 is in the path of clockwise rotation of the plate and thereby prevents movement of the handles 37, 39 to the ON position. In this manner, the tied handles 37, 39 are prevented from being turned ON when the tied handles 35, 41 are in the ON position, and vice versa.

In conclusion, the device of this invention solves a prior existing problem which was particularly inherent in recreational vehicles for eliminating the operation of two separate electric power supplies simultaneously. In addition, it provides for the prevention of the use of branch circuits where desirable.

What is claimed is:

1. A power transfer device for switching from one power supply to another, (a) four circuit breakers in side-by-side fixed alignment in a row, each of the circuit breakers having a top wall and a handle projecting therefrom and movable between "on" and "off" positions, (b) the first and second circuit breakers in the row having separate line terminals and common load terminals, (c) the third and fourth circuit breakers in the row having separate neutral terminals and common load terminals, (d) first tie means interconnecting the handles of the first and fourth circuit breakers into pairs for simultaneous movement, (e) second tie means interconnecting the handles of the second and third circuit into pairs for simultaneous movement, (f) the first and second tie means each comprising a rigid tie member to enable operation of corresponding pairs of tied handles, and (g) a locking plate pivotally mounted for movement between the paths of movement of the pairs of tied circuit breaker handles, whereby movement of either of the pairs of tied handles to the "on" position pivots the locking plate into the path of movement of the other pair to prevent movement to the "on" position.

2. The device of claim 1 in which all of the handles are in alignment when in the "off" position.

3. The device of claim 1 in which the locking plate comprises first and second mutually perpendicular locking surfaces, and is pivoted between one of the adjacent pairs of handles.

4. The device of claim 1 in which a fifth circuit breaker having a handle projecting therefrom is proximate to and on the load side of one of the first and second circuit breakers, and the first tie means including an arm extending across the path of movement of the fifth circuit breaker handle to prevent movement thereof when the first tie means is in one of the "on" and "off" positions of the associated circuit breakers.

5. The device of claim 4 in which a sixth circuit breaker having a handle projecting therefrom and on the load side of the first and second circuit breakers and is disposed in side-by-side position with the fifth circuit breaker and the arm extending across the path of movement of the sixth circuit breaker handle.

* * * * *